US005744736A

United States Patent [19]

Chang

[11] Patent Number: 5,744,736

[45] Date of Patent: Apr. 28, 1998

[54] WINDCHIMES

[76] Inventor: Ching-Ho Chang, 2F, No. 5, Alley 8, Lane Szu Wei, Chung Cheng Rd., Hsin-Tien Taipei Hsien, Taiwan

[21] Appl. No.: 711,234

[22] Filed: Sep. 9, 1996

[51] Int. Cl.[6] ..... G10D 13/08

[52] U.S. Cl. ..... 84/402; 84/404; 84/103; 116/141; 116/169; D10/116; D10/119

[58] Field of Search ..... 84/402, 404, 102, 84/103; 116/141, 169; D17/22, 99; 446/418; D10/116, 119

[56] References Cited

U.S. PATENT DOCUMENTS 2,104,963 1/1938 Anderson ..... 84/103
5,208,578 5/1993 Tury et al. ..... 84/404
5,266,732 11/1993 Suzuki ..... 84/103
5,369,391 11/1994 Gadsby ..... 84/404
5,450,779 9/1995 Yancy ..... 84/404

*Primary Examiner*—Cassandra C. Spyrou
*Attorney, Agent, or Firm*—Beveridge, DeGrandi, Weilacher & Young LLP

[57] ABSTRACT

An improvement to windchimes is provided which comprises a supporting bracket. A cluster of chimes with different notes are hanged under the peripheral edge of the supporting bracket. Characterized in that an electric powered main pendulum is hanged under the center of the supporting bracket to play a preset melody or song. An auxiliary pendulum is hanged under the main pendulum. When the auxiliary pendulum is blown by the wind, a natural notes can be heard by the tinkling to the chimes.

6 Claims, 5 Drawing Sheets

WINDCHIMES

FIELD OF THE INVENTION

This invention relates to an improvement to a windchimes, more particularly, to windchimes which can tinkle as blown by the wind or to be operated with electronic melodies or songs through an electric circuit. By this arrangement, a value-added and novel windchimes is provided.

BACKGROUND OF THE INVENTION

The conventional windchimes comprises a cluster of chimes hung on the peripheral edge of a supporting bracket. A pendulum is hanged also in the middle of the supporting bracket to strike the chimes when blown by the wind. In use, the windchimes tinkles as blown by the wind, on the other hand, it can be hanged directly on or adjacent to the door, as the door is opened, the swinging motion will cause the chimes and the pendulum to strike each other to sound.

Nevertheless, the conventional windchimes is operated at the predetermined manner, a single note can be heard when the chime is stricken by the pendulum. It can never sound a melody or a song. By this arrangement, the utilization of the conventional windchimes is limited. It is better to sound a melody according to different seasons. If it really does, the value of the windchimes is no doubt increased to an extent.

SUMMARY OF THE INVENTION

It is the object of this invention to provide an improvement to a windchimes wherein the windchimes is incorporated with a circuit to be controlled according one's taste or festival or celebration to sound related melody or song to make it become a more value-added article.

It is the object of this invention to provide an improvement wherein the windchimes can be operated in a natural mode or a electric mode.

In order to achieve the object set forth, the improvement to a windchimes made according to this invention generally comprises a supporting bracket to be hanged on a supporter, for example a door or the like. The peripheral edge of said supporting bracket has a cluster of chimes with different notes hanging therefrom. An electrical powered primary pendulum is hanged in the center of the supporting bracket which can strike the chimes as actuated. Furthermore, an auxiliary pendulum is attached to said pendulum which can strike the chimes to sound random notes as blown by the wind. Besides, this windchimes can sound a melody or song through a controlled circuit when this circuit is triggered.

According to one preferred embodiment of the invention, the main pendulum includes a cluster of strikers each corresponding to a chimes to be stricken. Each of said strikers is controlled by an electromagnet. When the electromagnet is excited, the actuated striker contacts the corresponding chime. By the controlling of a controlling circuits stored with a preset melody, a suitable melody can be heard.

BRIEF DESCRIPTION OF DRAWINGS

These and other objects, shape and configuration or device and characteristics may become more apparent in conjunction with the following description and drawings which are explanatory and not for limitation, wherein.

DETAILED DESCRIPTION OF PREFERRED EMBODIMENT

Figure 1:
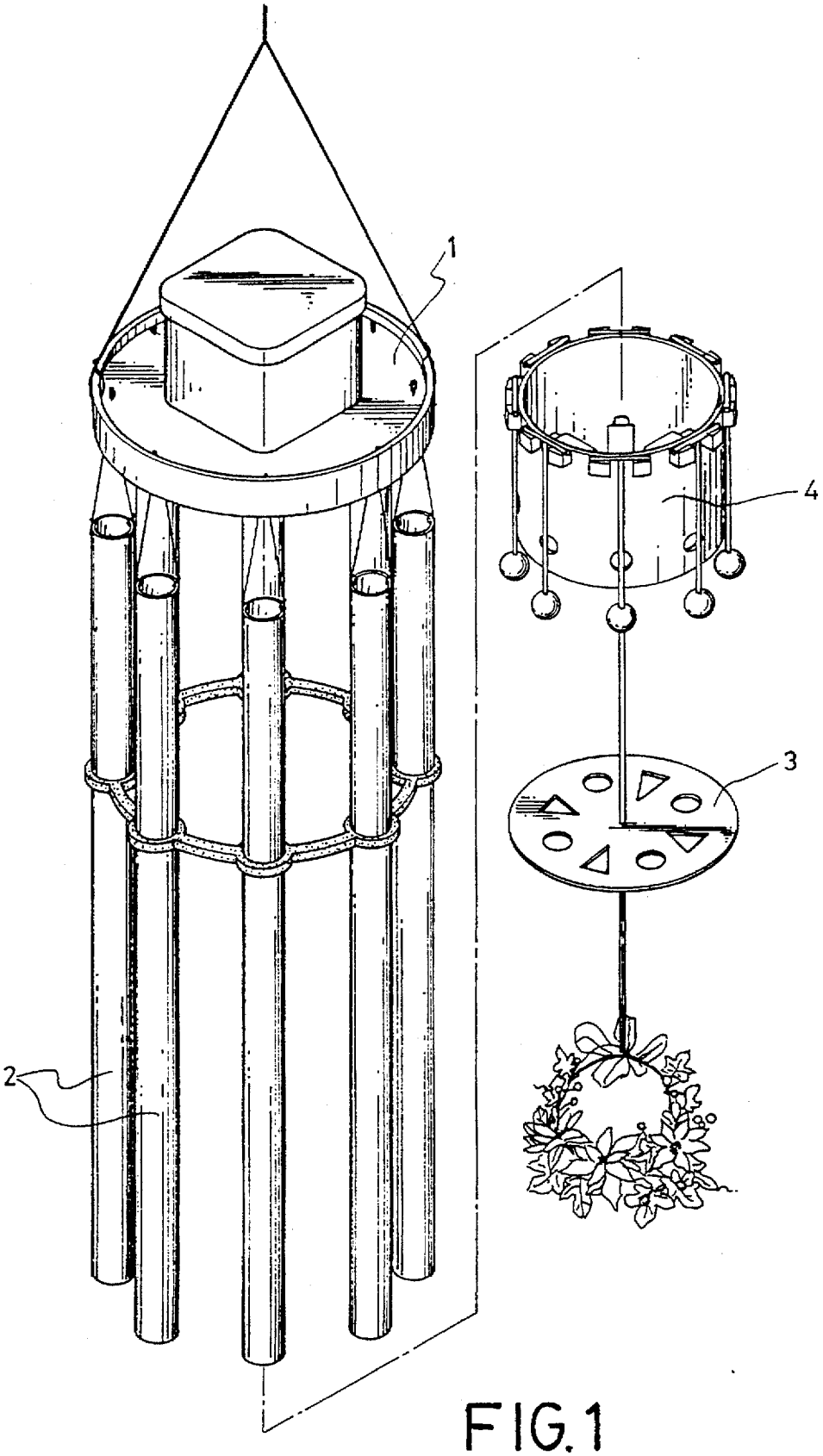
FIG. 1 is an exploded perspective view of the windchimes made according to this invention.
Figure 2:
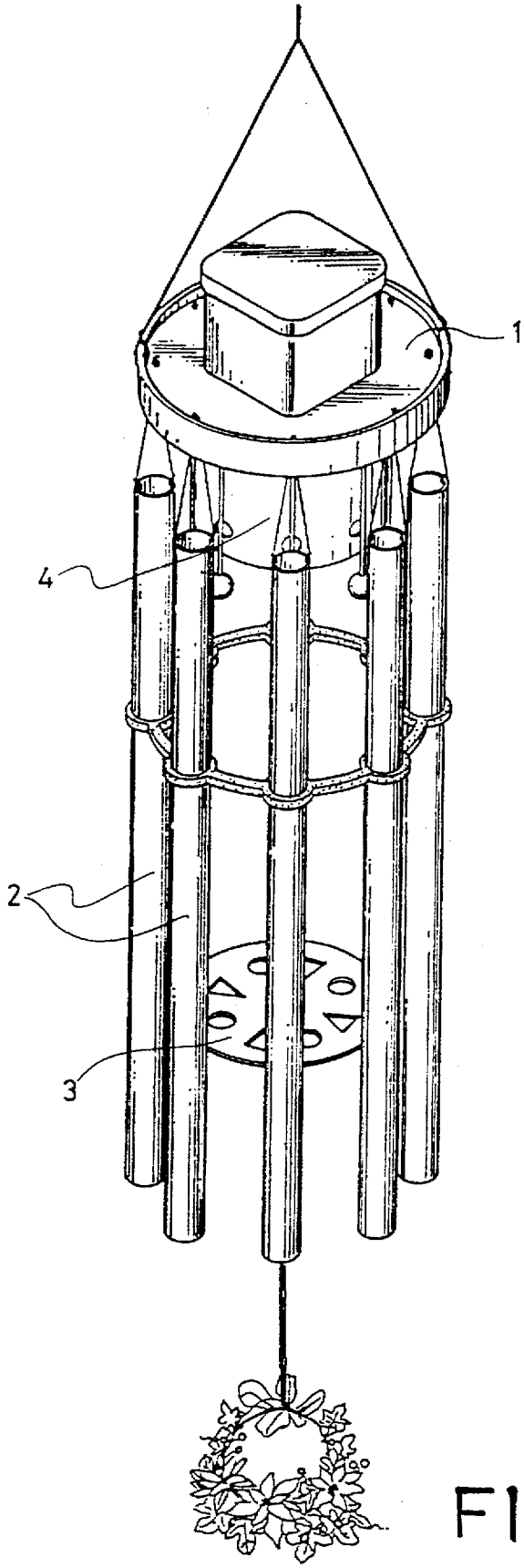
FIG. 2 is an assembled perspective view of the windchimes made according to this invention.

Referring to FIGS. 1 and 2, the improvement of a windchimes made according to this invention generally comprises a supporting bracket 1. A cluster of chimes 2 are hanged along the peripheral edge of said supporting bracket 1. Each of said chimes 2 has a preset note. An electrical powered pendulum 4 is hanged under the center of the supporting bracket 1. An auxiliary pendulum 3 is hanged under said main pendulum 4. By this arrangement, when the auxiliary pendulum 3 is blown by the wind, it may strike the chime 2 to sound. On the other hand, when the electrical powered main pendulum 4 is actuated, the windchimes can play a melody or song in a preset manner by an IC circuit.

Figure 3:
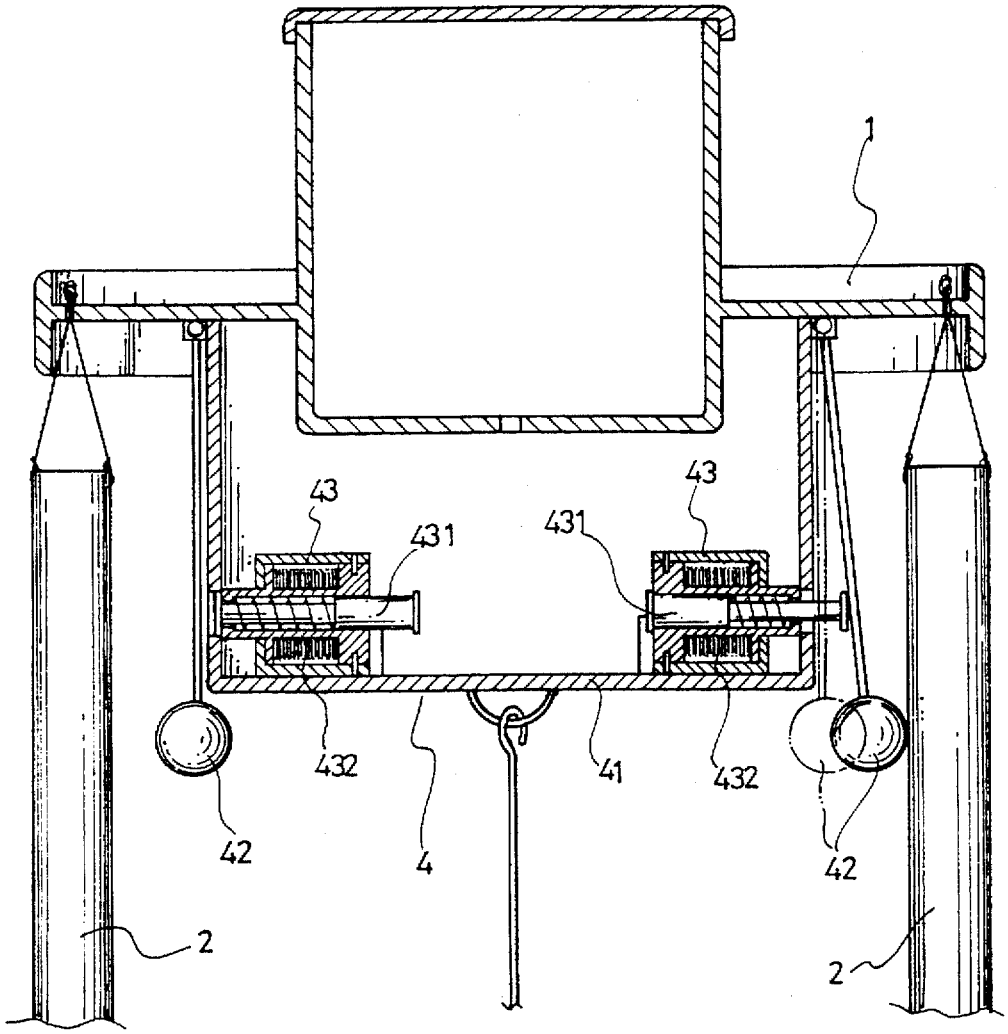
FIG. 3 is the striker of the electrical powered main pendulum in first embodiment.
Figure 4:
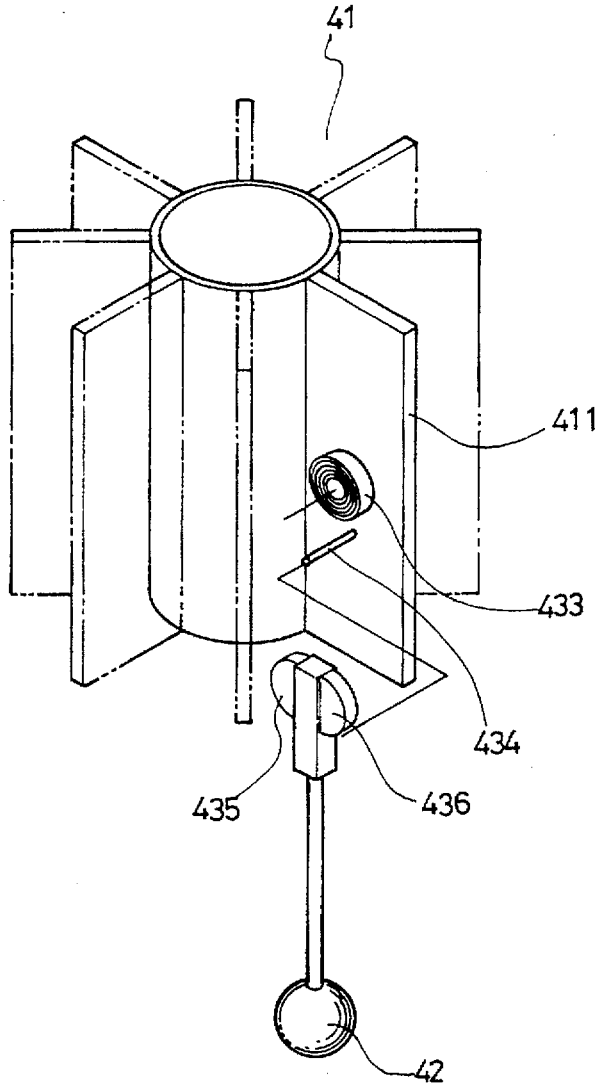
FIG. 4 is the striker of the electrical powered main pendulum in second embodiment.

Said main pendulum 4 generally includes a cluster of strikers 42 disposed at the housing 41 of said main pendulum 4, as clearly shown in FIGS. 3 and 4. Each of said strikers 41 is controlled by an electromagnet 43. When said electromagnet 43 is excited, said striker 42 is pushed out to strike the corresponding chime 2. Since the exciting of the electromagnet 43 is controlled an IC circuit 5, accordingly, a preset melody or song can be heard by the striking of said striker 42 to the chimes 2.

In order to ensure an effect striking between the striker 42 and the corresponding chimes 2, said chimes 2 are limited and bonded by a positioning ring 21 as seen in FIGS. 1 and 2. This positioning ring 21 can be readily removed in natural-wind-tinkle mode.

Referring to FIG. 3, the freely pivoted striker 42 is disposed at the upper portion of a tubular housing 41. Each of said striker 42 is incorporated with an electromagnet 43 which its iron core 431 aims to said striker 41. When said electromagnet 43 is excited by the current flows over the winding 432, said iron core 431 is extended by the pushing force of the electromagnet 43 in such a manner that said iron core 431 is stricken to a corresponding chime 2 to tinkle.

Now referring to FIG. 4, the main pendulum 4 can be configured with another structure. In this embodiment, the pendulum 4 is configured with a plurality of vertical plate 411 supported on said housing 4. Each of said vertical plate 411 is disposed with an exciting winding 433. A mounting shaft 434 is pivotedly mounted at the center of the exciting winding 433 disposed at said vertical plate 411. A striker 42 is mounted at said mounting shaft 434. The upper portion of said striker 42 is disposed with a pair of permanent magnets 435, 436 which have opposite polarity, one is N and the other is S. When a current flows over the winding 433, a magnetic field is generated adjacent to said permanent magnets 435, 436. By the attractive and repulsive force therebetween, said striker 42 may tinkle the chime 2.

Figure 5:
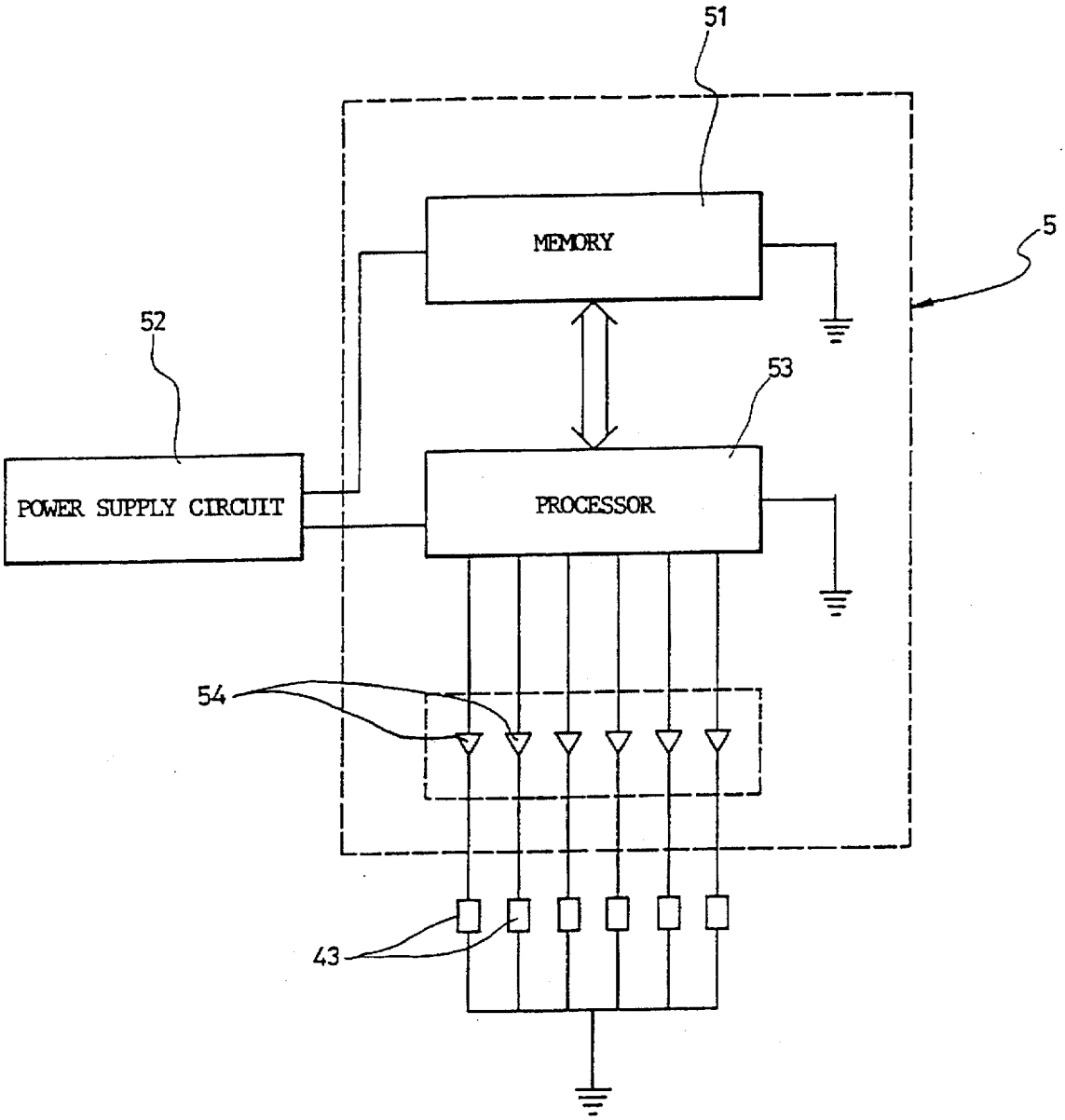
FIG. 5 is a block diagram of the circuit incorporated in the windchimes made according to this invention.

Now referring to FIG. 5, the electronic circuit 5 incorporated in the windchimes made according to this invention. In this circuit 5, a plurality of melodies or songs can be stored in a memory 51. When the circuit 5 is powered on by power supply circuit 52, the processor 53 may retrieve the information stored in said memory 51 and output the retrieved information. Meanwhile, a trigger 54 will excite the electromagnet 43 for operation. The electronic circuit 5 can be embodied in a single IC or a plurality of IC.

From the foregoing description, the windchimes made according to this invention can be operated in natural mode or power mode. It is really a value-added article. While particular embodiment of the present invention has been illustrated and described, it would be obvious to those skilled in the art that various other changes and modifications can be made without departing from the spirit and scope of the invention. It is therefore intended to cover in the appended claims all such changes and modifications that are within the scope of the present invention.

I claim:

1. A windchime, comprising:

a supporting bracket, a plurality of chimes supported by said supporting bracket;

an electrical powered main pendulum being supported by said supporting bracket at a center portion thereof to strike said chimes for playing a melody or song; and an auxiliary pendulum supported by said main pendulum to be blown by wind.

2. The windchime according to claim 1, wherein said striking means is controlled by a controlling circuit to play a preset melody or song.

3. The windchime according to claim 1, wherein said main pendulum includes a cluster of strikers each being pivotedly disposed on said main pendulum, a lower portion of said striker includes an iron core and is slidably disposed proximal to a winding, said iron core and said winding forming an electromagnet switch wherein, when current flows through said winding and causes said electromagnet switch to activate, said iron core is displaced.

4. The windchime according to claim 1, wherein a positioning ring is provided to limit movement of said chimes for ensuring said chimes are striken by said striker.

5. A windchime, comprising:

a supporting bracket, a plurality of chimes supported by said supporting bracket; and an electrical powered main pendulum being supported by said supporting bracket at a center portion thereof to strike said chimes for playing a melody or song, wherein said main pendulum includes a plurality of vertical plates, each of said vertical plates has an excitable electromagnetic winding and a pivoting mounting shaft disposed thereon, a striker being mounted on each mounting shaft, an upper portion of each mounting shaft having a pair of permanent magnets, each having opposite polarity, mounted thereon, and wherein when a current flows over said electromagnetic winding, a magnetic field is generated adjacent to said permanent magnets, by the attractive and repulsive force therebetween, said mounting shaft and said striker are displaced.

6. A windchime, comprising:

a supporting member;

a plurality of chimes supported by said supporting member;

first striking means for striking a first chime;

second striking means for striking a second chime;

first actuating means for actuating said first striking means, said first actuating means being supported by said supporting member;

second actuating means for actuating said second striking means, said second actuating means being supported by said supporting member;

a control means for controlling said first and said second actuating means; and third striking means for striking said plurality of chimes, said third striking means being pivotally supported by said supporting member.

* * * * *